US009845618B2

(12) United States Patent
Worm et al.

(10) Patent No.: US 9,845,618 B2
(45) Date of Patent: Dec. 19, 2017

(54) SHOCK RESISTANT LOCK

(75) Inventors: Steven L. Worm, Raleigh, NC (US); David G. Christopherson, Raleigh, NC (US); Michael R. Clark, Lexington, KY (US)

(73) Assignee: Sargent & Greenleaf, Inc., Nicholasville, KY (US)

( * ) Notice: Subject to any disclaimer, the term of this patent is extended or adjusted under 35 U.S.C. 154(b) by 842 days.

(21) Appl. No.: 13/639,654

(22) PCT Filed: Apr. 7, 2011

(86) PCT No.: PCT/US2011/031620

§ 371 (c)(1),
(2), (4) Date: Oct. 5, 2012

(87) PCT Pub. No.: WO2011/127310

PCT Pub. Date: Oct. 13, 2011

(65) Prior Publication Data

US 2013/0033045 A1 Feb. 7, 2013

Related U.S. Application Data

(60) Provisional application No. 61/321,619, filed on Apr. 7, 2010.

(51) Int. Cl.
*E05C 3/06* (2006.01)
*E05B 47/06* (2006.01)
(Continued)

(52) U.S. Cl.
CPC ..... *E05B 47/06* (2013.01); *E05B 65/0075* (2013.01); *E05B 17/2034* (2013.01);
(Continued)

(58) Field of Classification Search
CPC ..... E05B 17/2034; E05B 2047/0023
(Continued)

(56) References Cited

U.S. PATENT DOCUMENTS 4,135,377 A * 1/1979 Kleefeldt et al. ..... 70/264
5,142,890 A * 9/1992 Uyeda et al. ..... 70/277
(Continued)

FOREIGN PATENT DOCUMENTS

CN 1295641 5/2001
CN 1867746 11/2006
(Continued)

OTHER PUBLICATIONS

Examination Report dated Jun. 24, 2014, issued by Chinese Patent Office for related Application No. 201180018364.7 (Chinese language); 6 pages.
(Continued)

*Primary Examiner* — Carlos Lugo
(74) *Attorney, Agent, or Firm* — Caeden Drayton; Adan Ayala

(57) ABSTRACT

A lock assembly (30, 30') is provided that includes a housing (32), a rotary bolt (36) or a translating bolt (36'), and a bolt blocker (38) that moves between a blocking position blocking movement of the bolts (36, 36') and an unblocking position permitting the bolts (36, 36') to move to a retracted position. The lock assemblies (30, 30') are resistant to shocks being applied to the locks assemblies (30, 30') in an effort to open the lock assemblies (30, 30') without authorization.

4 Claims, 12 Drawing Sheets

(51) Int. Cl.

| | |
|---|---|
| ***E05B 65/00*** | (2006.01) |
| *E05C 3/00* | (2006.01) |
| *E05B 17/20* | (2006.01) |
| *E05B 47/00* | (2006.01) |

(52) U.S. Cl.
CPC ..... *E05B 17/2038* (2013.01); *E05B 47/0012* (2013.01); *E05B 2047/0023* (2013.01); *Y10T 292/08* (2015.04); *Y10T 292/0803* (2015.04)

(58) Field of Classification Search
USPC ..... 292/201, 216, DIG. 23, 144
See application file for complete search history.

(56) References Cited

U.S. PATENT DOCUMENTS

| | | | | |
|---|---|---|---|---|
| 5,149,156 | A * | 9/1992 | Kleefeldt | 292/336.3 |
| 5,441,315 | A * | 8/1995 | Kleefeldt et al. | 292/201 |
| 5,473,922 | A * | 12/1995 | Bair et al. | 70/416 |
| 5,592,838 | A * | 1/1997 | Clark et al. | 70/303 A |
| 6,016,677 | A | 1/2000 | Clark | |
| 6,178,791 | B1 * | 1/2001 | Hill et al. | 70/276 |
| 6,209,932 | B1 * | 4/2001 | Jung et al. | 292/216 |
| 6,786,519 | B2 * | 9/2004 | Gartner | 292/195 |
| 7,461,872 | B2 * | 12/2008 | Moon et al. | 292/209 |
| 7,770,944 | B2 | 8/2010 | Yuan | |
| 8,261,586 | B2 * | 9/2012 | Gartner | 70/277 |
| 8,495,899 | B2 * | 7/2013 | Gartner | 70/278.1 |
| 8,826,709 | B2 * | 9/2014 | Dehaven et al. | 70/416 |
| 2008/0073916 | A1 * | 3/2008 | Min | 292/201 |

FOREIGN PATENT DOCUMENTS

| | | |
|---|---|---|
| GB | 2456214 | 7/2009 |
| JP | 6233981 | 2/1987 |
| JP | 2008-303699 | 12/2008 |
| WO | 9935356 | 7/1999 |

OTHER PUBLICATIONS

Examination Report dated Jun. 24, 2014, issued by Chinese Patent Office for related Application No. 201180018364.7 (Translated to English language); 6 pages.
Examination Report dated Aug. 12, 2014, issued by Japanese Patent Office for related Application No. 2013-503961 (Japanese language); 7 pages.
Examination Report dated Aug. 12, 2014, issued by Japanese Patent Office for related Application No. 2013-503961 (Translated to English language); 7 pages.
Examination Report dated Feb. 10, 2014, issued by Australian Patent Office for related Application No. 2011237429; 4 pages.
Examination Report dated Sep. 26, 2014, issued by Korean Patent Office for related Application No. 10-2012-7029081 (Korean language); 6 pages.
Examination Report dated Sep. 26, 2014, issued by Korean Patent Office for related Application No. 10-2012-7029081 (Translated to English language); 8 pages.
Examination Report dated Sep. 25, 2014, issued by Mexican Patent Office for related Application No. MX/a/2012/011653 (Translated to English language); 7 pages.
International Search Report and Written Opinion of International Searching Authority; dated Jun. 9, 2011; International application No. PCT/US2011/031620 filed Apr. 7, 2011.

* cited by examiner

SHOCK RESISTANT LOCK

CROSS-REFERENCE TO RELATED APPLICATIONS

This application is a nationalization of PCT Patent Application Serial No. PCT/US2011/031620, filed Apr. 7, 2011, which claims the benefit of U.S. Provisional Application No. 61/321,619 filed on Apr. 7, 2010, the disclosures of which are expressly incorporated herein by reference.

BACKGROUND AND SUMMARY OF THE INVENTION

The present invention relates generally to locks. More particularly, the present invention related to locks that are more difficult, if not impossible, to open when a shock or impact force is applied in an effort to defeat the lock.

According to one aspect of the present invention, a lock assembly is provided for securing a container having an interior region. The lock assembly includes a housing, a bolt moveable relative to the housing between an extended position inhibiting access to the interior region of the container and a retracted position to facilitate access to the interior region, and a blocking lever rotating relative to the housing between a blocking position blocking movement of the bolt to the retracted position and an unblocking position permitting the bolt to move to the retracted position. The blocking lever has a first lever arm and a second lever arm. The lock assembly further includes a positioning assembly including a threaded shaft, a motor that rotates the threaded shaft, and a nut that moves relative to the housing along the threaded shaft as the motor rotates the threaded shaft to adjust the location and/or amount of force applied to the blocking lever by the nut.

According to another aspect of the present disclosure, a lock assembly is provided for securing a container having an interior region. The lock assembly includes a housing, a bolt moveable between a locked position to inhibit access to the interior region of the container and an unlocked position to facilitate access to the interior region, a bolt blocker moveable between a blocking position to inhibit movement of the bolt to the unlocked position and an unblocking position to facilitate movement of the bolt to the retracted position, and a positioning assembly moveable between a first position applying a force to a first location on the bolt blocker and a second position applying a force to a second location on the bolt blocker to change the position of the bolt blocker.

According to another aspect of the present invention, a lock assembly is provided for securing a container having an interior region. The lock assembly includes a housing, a bolt moveable relative to the housing between an extended position inhibiting access to the interior region of the container and a retracted position to facilitate access to the interior region, a bolt blocker rotating relative to the housing between a blocking position blocking movement of the bolt to the retracted position and an unblocking position permitting the bolt to move to the retracted position. The bolt blocker translates relative to the housing between a starting position and an ending position when external force is applied to the bolt, such as by a person using a shock attack against the bolt works to attempt unauthorized access to the interior region.

According to another aspect of the present invention, a lock assembly is provided for securing a container having an interior region. The lock assembly includes a housing, a bolt moveable relative to the housing between an extended position inhibiting access to the interior region of the container and a retracted position to facilitate access to the interior region, a bolt blocker movable relative to the housing between a blocking position blocking movement of the bolt to the retracted position and an unblocking position permitting the bolt to move to the retracted position, and a positioning assembly including an electric machine that moves the bolt blocker between the blocking and unblocking positions. The electric machine floats relative to the housing to permit relative movement of the electric machine relative to the housing. The lock assembly further includes a compliant member positioned between the electric machine and the housing to absorb impact of the electric machine resulting from relative movement of the electric machine relative to the housing.

According to another aspect of the present invention, a lock assembly is provided for securing a container having an interior region. The lock assembly includes a housing having an interior region, and either a rotary bolt adapted to rotate relative to the housing between an extended position inhibiting access to the interior region of the container and a retracted position to facilitate access to the interior region of the container, or a translating bolt adapted to translate relative to the housing between an extended position inhibiting access to the interior region of the container and a retracted position to facilitate access to the interior region of the container. The housing is adapted to receive either of the rotary bolt and the translating bolt. In either case, because of the structures of the housing and bolts of the present invention, the rotary bolt and the translating bolt are positionable within the interior region of the housing to move between their respective extended and retracted positions.

According to another aspect of the present invention, a lock assembly is provided for securing a container having an interior region. The lock assembly includes a housing, a bolt moveable relative to the housing between an extended position inhibiting access to the interior region of the container and a retracted position to facilitate access to the interior region, a bolt blocker movable relative to the housing between a blocking position blocking movement of the bolt to the retracted position and an unblocking position permitting the bolt to move to the retracted position, and a positioning assembly movable between first, second, and third positions. The positioning assembly blocks movement of the bolt blocker from the blocking position when in the first position. Movement of the positioning assembly from the first position to the second position allows the bolt blocker to move to the unblocking position. When in the third position, the positioning assembly resists movement of the bolt blocker to the first position.

According to another aspect of the present invention, a lock assembly is provided for securing a container having an interior region. The lock assembly includes a housing, a bolt moveable relative to the housing between an extended position inhibiting access to the interior region of the container and a retracted position to facilitate access to the interior region, a bolt blocker movable relative to the housing between a blocking position blocking movement of the bolt to the retracted position and an unblocking position permitting the bolt to move to the retracted position, and a positioning assembly movable between a first position blocking movement of the bolt blocker from the blocking position, and a second position allowing the bolt blocker to move to the unblocking position. The positioning assembly includes an urging assembly normally applying a force to the bolt blocker at each of the first and second positions.

According to another aspect of the present invention, a lock assembly is provided for securing a container having an interior region. The lock assembly includes a housing, a bolt moveable relative to the housing between an extended position inhibiting access to the interior region of the container and a retracted position to facilitate access to the interior region, a bolt blocker having a range of motion and being movable relative to the housing between a blocking position blocking movement of the bolt to the retracted position and an unblocking position permitting the bolt to move to the retracted position, and an urging assembly positioned to urge the bolt blocker toward the blocking position. The bolt blocker has a range of motion against the urging assembly that is insufficient to move the bolt blocker to the unblocking position.

According to another aspect of the present invention, a method of securing a container having an interior region is provided. The method includes the steps of providing a lock assembly including a housing, a bolt moveable between a locked position to inhibit access to the interior region of the container and an unlocked position to facilitate access to the interior region, a bolt blocker moveable between a blocking position to inhibit movement of the bolt to the unlocked position and an unblocking position to facilitate movement of the bolt to the retracted position, and a positioning assembly. The method further includes the step of moving the positioning assembly between a first location applying force on the bolt blocker and a second position applying a force to a second location on the bolt blocker to change the position of the bolt blocker.

According to another aspect of the present invention, a method of securing a container having an interior region is provided. The method includes the steps of providing a lock assembly including a housing, a bolt moveable between a locked position to inhibit access to the interior region of the container and an unlocked position to facilitate access to the interior region, a bolt blocker moveable between a blocking position to inhibit movement of the bolt to the unlocked position and an unblocking position to facilitate movement of the bolt to the retracted position, and a positioning assembly. The method further includes moving the positioning assembly to a first location blocking the bolt blocker from moving to the unblocking position, moving the positioning assembly to a second location urging the bolt blocker toward the unblocking position, and moving the positioning assembly to a third location urging the bolt blocker toward the blocking position.

BRIEF DESCRIPTION OF THE DRAWINGS

The detailed description of the drawings particularly refers to the accompanying figures in which.

DETAILED DESCRIPTION OF ILLUSTRATIVE EMBODIMENTS

The embodiments of the present invention disclosed below are not intended to be exhaustive or to limit the invention to the precise forms disclosed in the following detailed description. Rather, the embodiments are chosen and described so that those skilled in the art may utilize their teachings.

Figure 1:
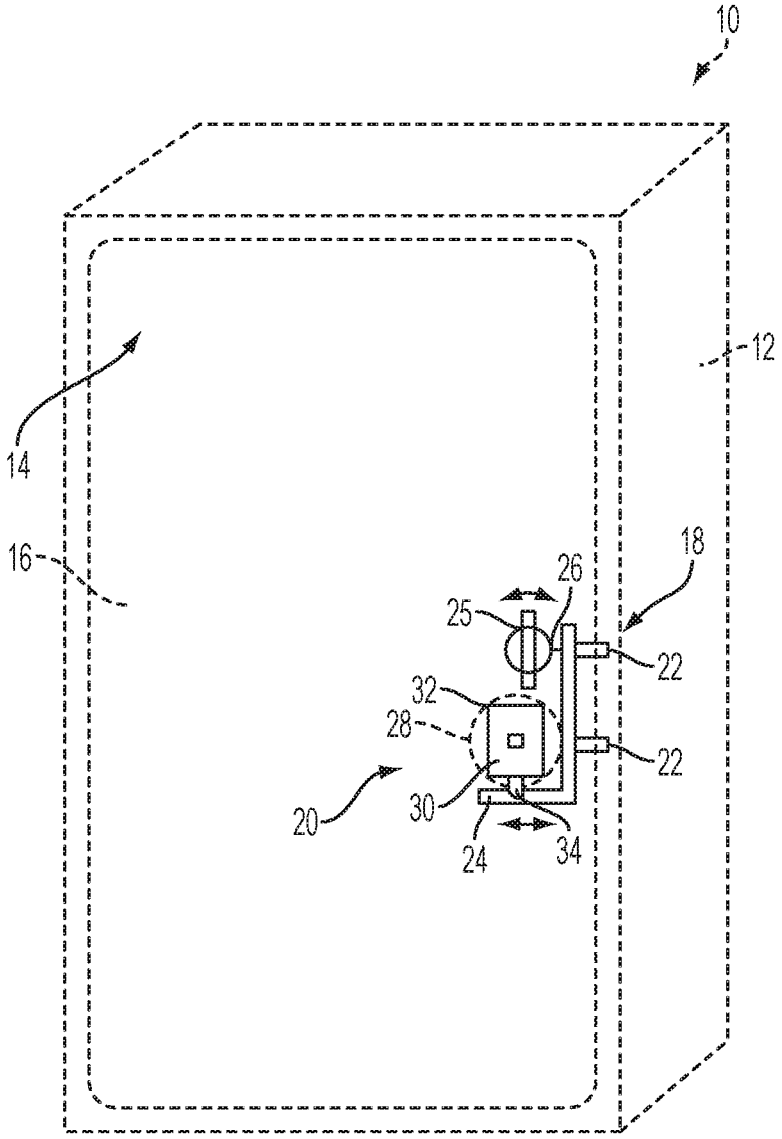
FIG. 1 is a perspective view of a safe showing the safe cabinet in phantom, the bolt works in solid lines, and a lock of the present invention in solid lines.

As shown in FIG. 1, a container, such as a safe 10, is shown including a case 12 (shown in phantom) defining an interior region 14, and a door 16 (shown in phantom) pivotably coupled to case 12 to normally block access to interior region 14. Door 16 may be opened by authorized users to permit access into interior region 14 and the objects stored therein (not shown).

Safe 10 further includes bolt works 18 that normally blocks opening of door 16 and a lock 20 that normally blocks operation of bolt works 18. Bolt works 18 may be supported on door 16 and includes one or more bolts 22 that extend across the interface between door 16 and case 12 into apertures (not shown) in case 12 to prevent opening of the door 16. Bolts 22 are coupled to a throw member 24. Bolt works 18 further includes a handle 25 coupled to a lever 26. When handle 25 is rotated, lever 26 rotates to translate throw member 24 to the left (as shown in FIG. 1), unless lock 20 is blocking this translation. Sufficient translation of throw member 24 will pull bolts 22 from the apertures in case 12 and allow door 16 to be opened. Additional details of a suitable bolt works is provided in U.S. Pat. No. 5,142,890 to Uyeda et al., the entire disclosure of which is expressly incorporated by reference herein.

As mentioned above, lock 20 normally blocks movement of bolt works 18; and, therefore, unlocking of door 16. Lock 20 includes an access control point 28 (shown in phantom), such as a round key pad, and a lock assembly 30. Access control point 28 provides instructions to lock assembly 30 on when to allow safe 10 to be opened. Lock assembly 30 controls blocking of bolt works 18.

As shown in FIG. 1, lock assembly 30 includes a housing 32 and a bolt 34 that extends from housing 32. When extended and in a locked state, bolt 34 blocks movement of throw member 24 and bolts 22. When extended and in an unlocked state, bolt 34 allows movement of throw member 24 and bolts 22 to allow opening of door 16.

In the lock assembly 30 of the present invention shown in FIGS. 1-7, bolt 34 is a rotary bolt 36. Another embodiment of the present invention, lock assembly 30' shown in FIGS. 8-11, includes a linear bolt 36'. Otherwise, lock assembly 30' is very similar to lock assembly 30. As such, common structures will be described and illustrated using the same reference numbers.

In addition to safes, lock assemblies 30, 30' may be used on other containers and devices providing secure access. For example, lock assemblies 30, 30' may be provided on ATM's, filing cabinets, rooms, and other devices requiring secure access. Such devices may have cases with sliding doors. For example, filing cabinets have a case defining an interior region and a sliding drawer with a door defining the face of the door blocking access to the interior region.

Figure 2:
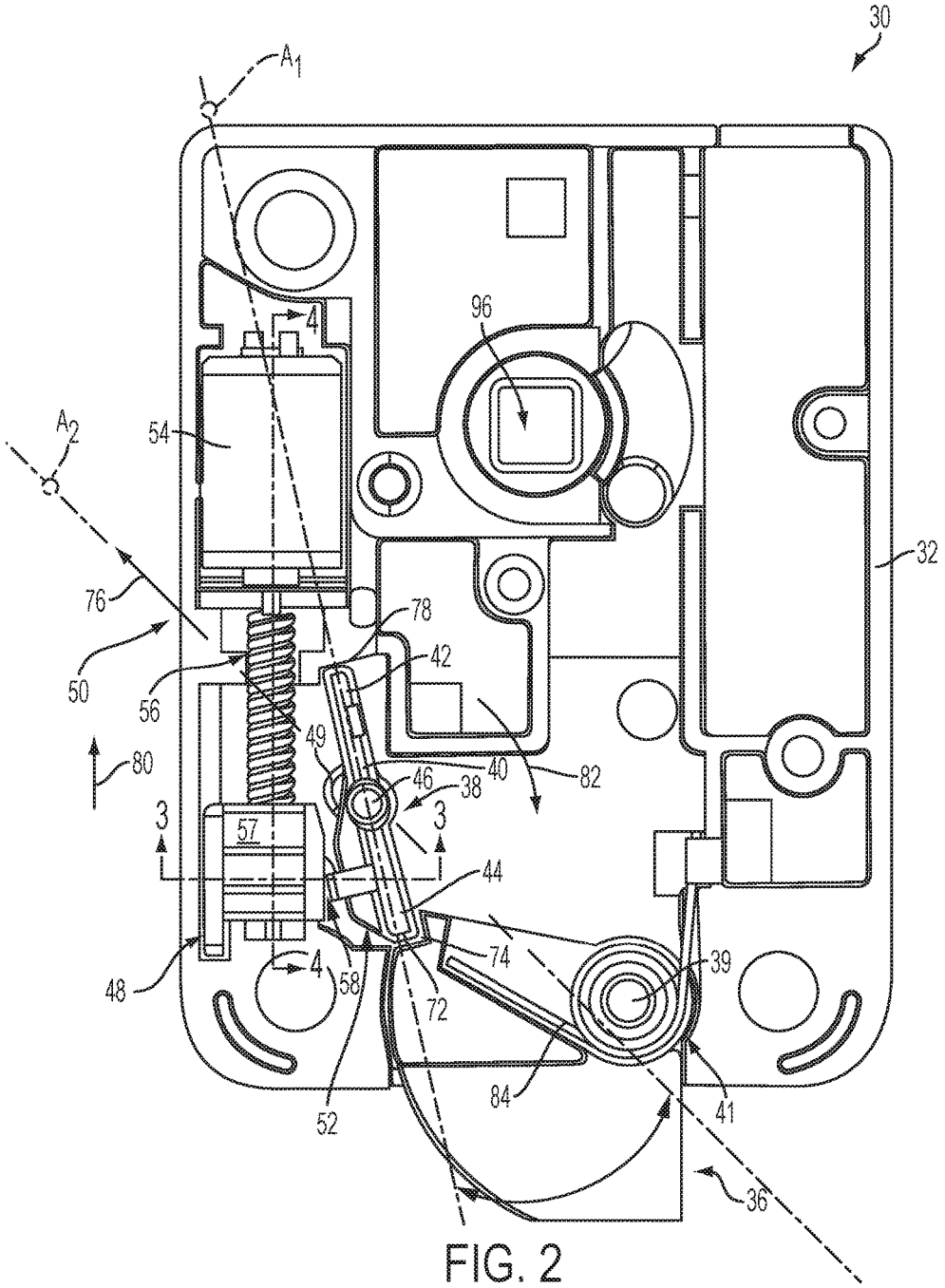
FIG. 2 is an elevational view of the lock of the present invention showing the lock including a case and a rotary bolt in an extended position to block movement of the bolt works, and a bolt blocker positioned to block retraction of the rotary bolt.

As shown in FIG. 2, lock assembly 30 includes a bolt blocker 38 that controls the ability of rotary bolt 36 to retract. Rotary bolt 36 rotates about rotary bolt shafts 39 in rotary bolt shaft-receiving apertures 41.

Bolt blocker 38 includes a blocking lever or lever body 40 defining a longitudinal axis $A_1$ having first and second arms 42, 44 and a pair of pivot pins 46 (one shown in FIG. 2). Pivot pins 46 are received in identical oval-shaped recesses or slot 49 in housing 32 and a lock cover 33 (see FIGS. 3 and 4). Pins 46 pivot in recesses 49 to allow lever body 40 to pivot. The first and second arms 42, 44 of bolt blocker 38 lie substantially along axis $A_1$.

Lock assembly 30 further includes a positioning assembly including a nut 48 and an electric machine, such as a motor assembly 50 that drives nut 48 between several positions. Motor assembly 50 includes a motor 54 having a housing 55 and a threaded shaft 56 that extends into nut 48. According to alternative embodiments of the present invention, other electric machines, such as a solenoid or other types of electric machines, may be provided.

Figure 3:
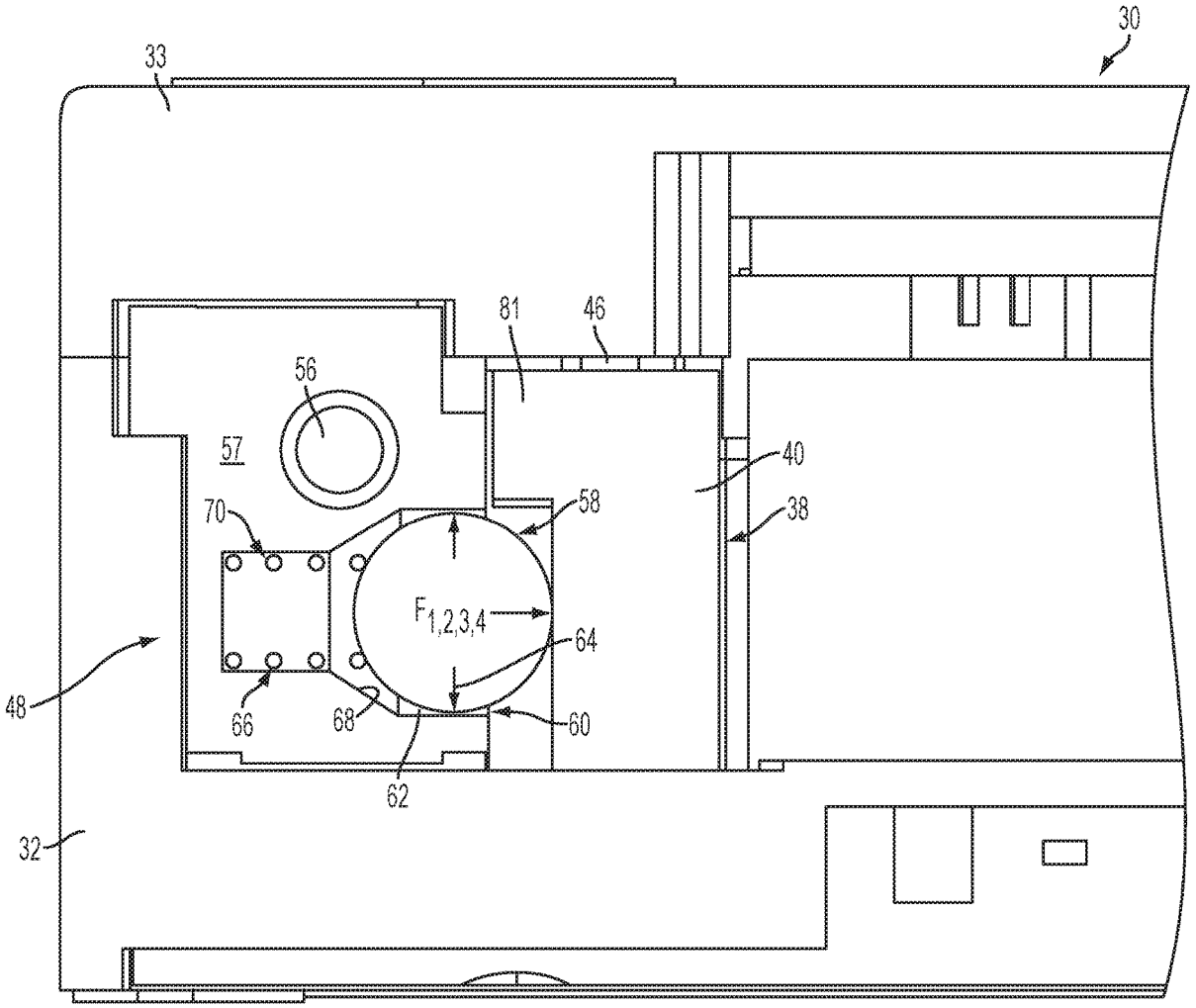
FIG. 3 is a cross-sectional view taken along line 3-3 of FIG. 2 showing a portion of the bolt blocker and a nut including a spring-biased ball that contacts the bolt blocker.

An urging assembly includes a nut 48, which includes a nut body 57 and a circular member 58 at least partially positioned in nut body 57 as shown in FIG. 3. Circular member 58 is preferably a ball-shaped contact member, but may be other shapes, such as a cylinder, or non-circular shapes. As shown in FIG. 3, nut body 57 also includes a recess 60 including a cylindrical portion 62 having a diameter 64 equal to or slightly larger than a diameter of ball 58 to allow ball 58 to move within cylindrical portion 62 against the bias of a spring 66 (also included in the urging assembly) positioned in recess 60. Recess 60 further includes a conical portion 68 and another cylindrical portion 70 that receive portions of spring 66. Spring 66 urges ball 58 outward and against an outcropping portion 52 of second arm 44 of bolt blocker 38, causing bolt blocker 38 to be biased by force $F_1$ in the counter-clockwise direction, as shown by arrow ccw in FIG. 12A, when nut 48 is in the position shown in FIG. 2.

Figure 12A:
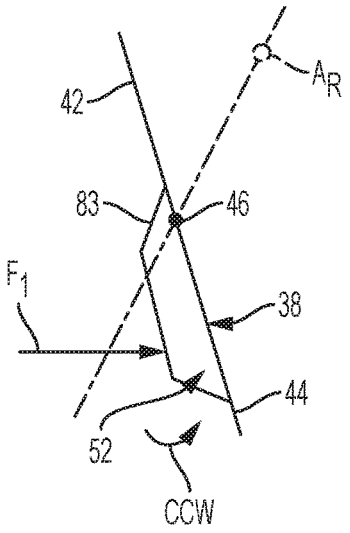
FIGS. 12A-12E are schematic force diagrams of the forces applied against the bolt blocker of the present invention by the positioning assembly of the present invention, corresponding to the positions of such elements shown in FIGS. 2, 5, 6 and 7.

When in the position shown in FIGS. 2 and 12A, bolt blocker 38 is in a first or blocking position and prevents rotary bolt 36 from retracting. In this position, the lock assembly 30 of the present invention also resists a shock attack by someone attempting to gain unauthorized access to interior region 14. A tip 72 of second arm 44 of bolt blocker 38 is positioned in a notch 74 of rotary bolt 36. If an external force, such as from a violent shock or strike to bolt works 18, is applied to rotary bolt 36, bolt blocker 38 slides or translates up slot or recess 49 from a starting position in direction 76 along a longitudinal axis $A_2$ until first arm 42 of bolt blocker 38 contacts wall 78 of housing 32 and the bolt blocker reaches an ending position. Still referring to FIG. 2, when such external force is applied to the bolt works 18, this creates a resultant force applied to the bolt blocker 38 by the rotary bolt 36. To cause the bolt blocker to translate along slot 49, the direction of such resultant force and the axis $A_2$ cooperate to define an angle $\alpha$ that is substantially greater than zero degrees and substantially less than ninety degrees. In FIG. 2, the resultant force is shown as being directed along axis $A_1$. Lever body 40 is then under compression and bears most, if not all, of the external force being applied by rotary bolt 36. Because pins 46 bear little, if any of this external force, they are not subject to much, if any, shearing load. Thus, enough force to crush or buckle lever body 40 (or wall 78 of housing 32) must be applied through rotary bolt 36 before lock assembly 30 will yield. Such force is difficult, if not impossible, to apply through bolt works 18. As a result, lock assembly 30 of the present invention is very difficult to unlock through forced entry.

Figure 5:
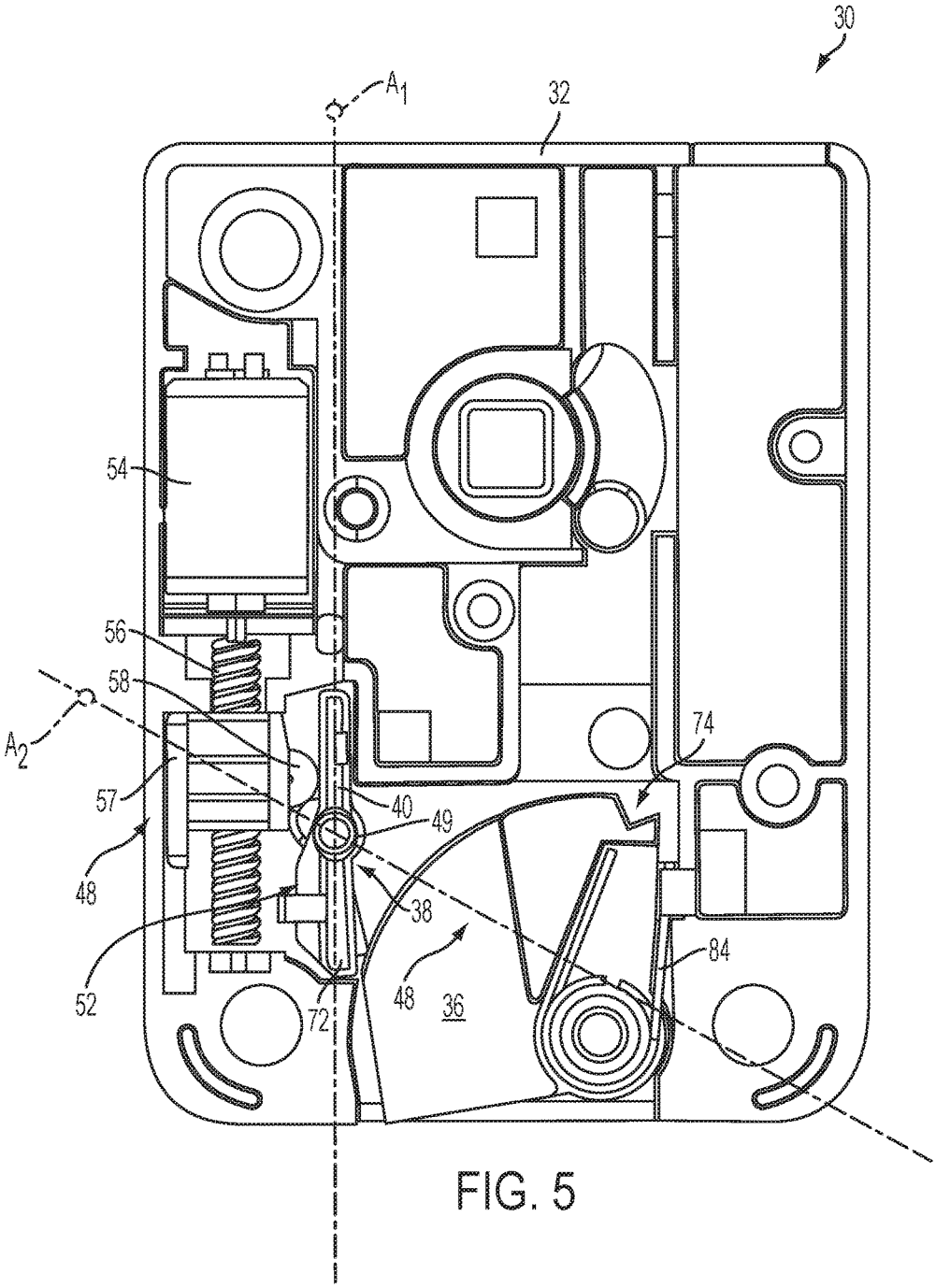
FIG. 5 is a view similar to FIG. 2 showing the nut driven to a raised position rotating the bolt blocker and allowing the bolt works to retract the rotary bolt into the case.
Figure 12B:
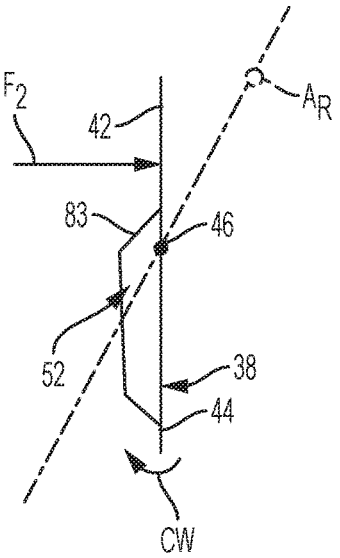

As mentioned above, safe 10 includes access control point 28 that receives access codes in the form of passwords or access codes, from a person, access cards, fobs, or from other sources. If access control point 28 receives a valid access code, it instructs lock assembly 30 to permit access to interior region 14 of safe 10. Upon receipt of such instructions, electric motor 54 rotates threaded shaft 56 is a direction that causes nut 48 to move in direction 80. Initially, as shown in FIG. 12A, the force $F_1$ applied by ball 58 on bolt blocker 38 is below the axis of rotation $A_R$ of pins 46 so that bolt blocker 38 continues to be biased in the counter-clockwise direction (arrow ccw in FIG. 12A). As nut 48 continues to move in direction 80, the force applied by ball 58 on bolt blocker 38 passes through the axis of rotation $A_R$ (FIGS. 12A=12E) of pins 46 so that bolt blocker 38 is no longer biased in the counter-clockwise direction. As motor 54 and threaded shaft 56 continue to move nut 48 toward motor 54, as shown in FIGS. 5 and 12B, the force $F_2$ applied by ball 58 is applied above the axis of rotation $A_R$ of pins 46 so that bolt blocker 38 is biased in the opposite or clockwise direction (arrow cw in FIG. 12B). Thus the bolt blocker 38 rotates to a second or unblocking position (also referred to as a first terminal position) so that tip 72 of bolt blocker 38 is no longer positioned in notch 74, as shown in FIG. 5.

Because bolt blocker 38 is now in the unblocking position with tip 72 of bolt blocker 38 away from notch 74, it no longer blocks rotation of rotary bolt 36 caused by external forces, such as bolt works 18. As discussed above, throw member 24 translates as handle 25 rotates in the direction to open safe 10. When bolt blocker 38 is in the unlatched position, throw member 24 pushes on rotary bolt 36 and causes rotary bolt 36 to move into housing 32, as shown in FIG. 5. Because rotary bolt 36 no longer blocks translation of throw member 24, bolts 22 no longer block door 16 from being open.

Figure 6:
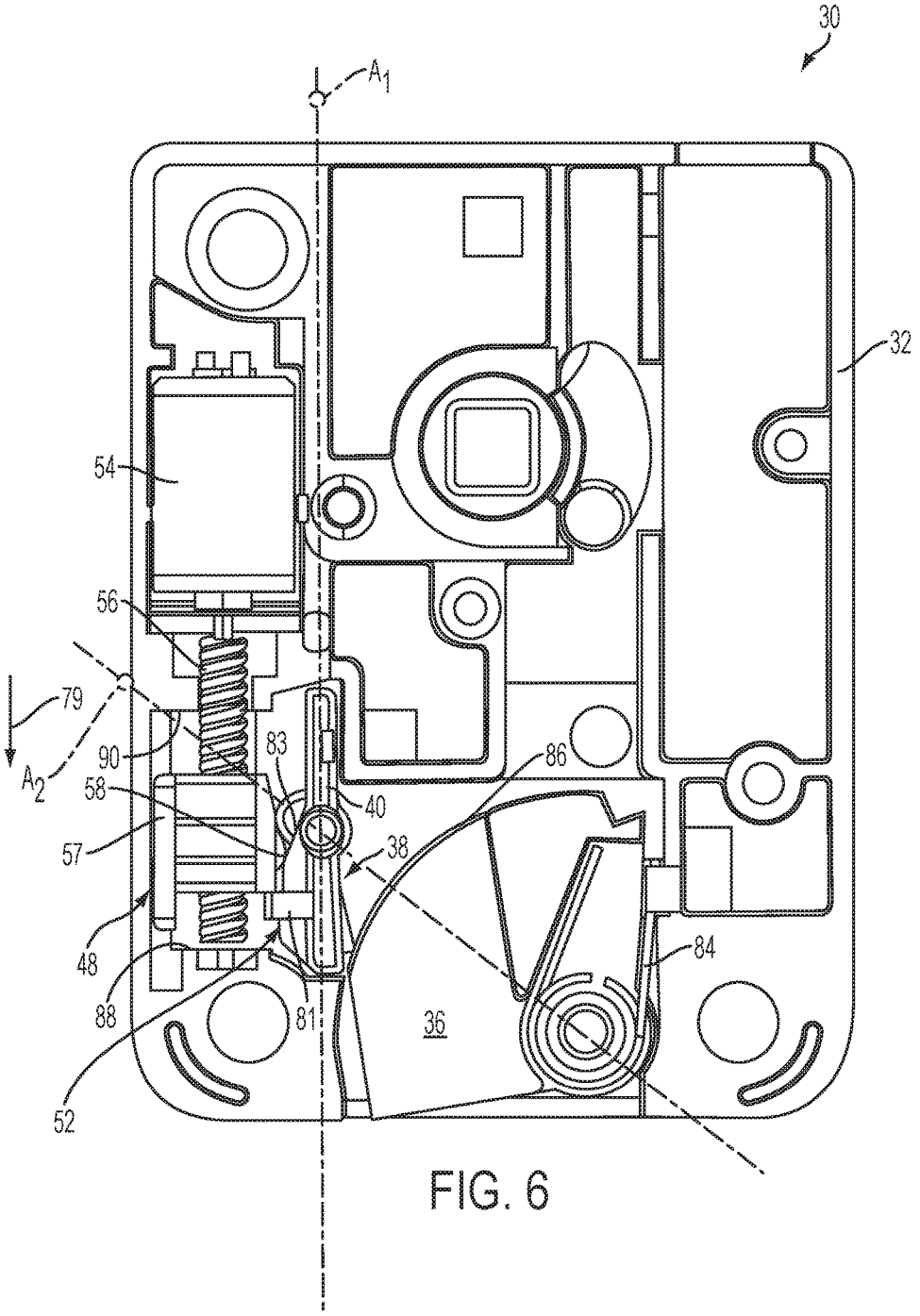
FIG. 6 is a view similar to FIG. 2 showing the nut driven back to an intermediate position urging the bolt blocker toward the rotary bolt.

Normally, lock 20 allows a predetermined time for door 16 to be opened. If this time has passed or another triggering event occurs, lock assembly 30 begins the process of re-securing door 16. After the trigger event, motor 54 and threaded shaft 56 move nut 48 down in direction 79 as shown in FIG. 6. During this movement, the force applied by ball 58 moves from applying a clockwise force to bolt blocker 38 to again applying a counter-clockwise force (arrow ccw in FIG. 12C).

Figure 12C:
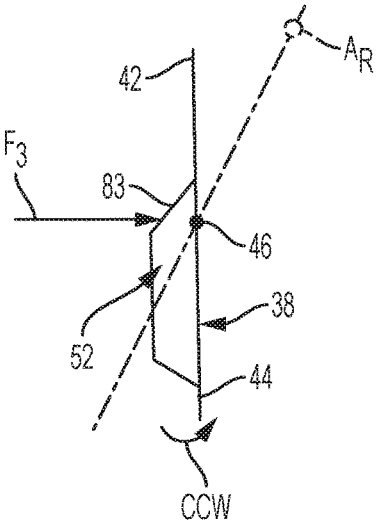

As shown in FIGS. 6 and 12C, ball 58 applies a force $F_3$ to a first ramped surface 83 of bolt blocker 36 in a counter-clockwise direction (arrow ccw in FIG. 12C) causing bolt blocker 38 to rotate (such rotation is not shown in FIG. 6). The movement of ball 58 along ramped surface 83 is limited by a finger or stop 81 on bolt blocker 38 to a third or intermediate position. During the downward movement of nut 48, nut 48 will contact finger 81 if it attempts to travel too far. By limiting the movement of nut 48, the movement of ball 58 is also limited. The farther ball 58 moves along ramped surface 83, the more ball 58 compresses spring 66 (FIG. 3). As the compression increases, the force applied against ball 58 increases, which increases the force applied by ball 58 on rotary bolt 36. Thus, by limiting the travel of nut 48, the amount of force applied by ball 58 on rotary bolt 36 is also limited. Additionally, when the positioning assembly is in the third or intermediate position shown in FIGS. 6 and 12C, friction between finger 81 and nut 48 resists, but does not prevent, the ability of bolt blocker 38 to rotate towards rotary bolt 36. By resisting this rotation, less force is applied to bolt blocker 38 by ball 58, and bolt blocker 38 applies less force on rotary bolt 36 so that spring 84 has sufficient force to extend rotary bolt 36 out of housing 32.

Figure 12D:
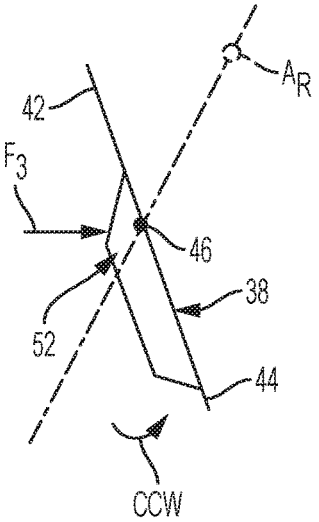

With the application of the counter-clockwise force $F_3$ by ball 58, as shown by arrow ccw in FIG. 12D, bolt blocker 38 moves counter-clockwise and into contact with rotary bolt 36. If bolt works 18 failed to rotate rotary bolt 36 into housing 32 (ex. the authorized person failed to open bolt works 18 in a timely manner), tip 72 would be positioned in notch 74 of rotary bolt 36 and would again block movement of rotary bolt 36 into housing 32, as shown in FIG. 2.

Figure 7:
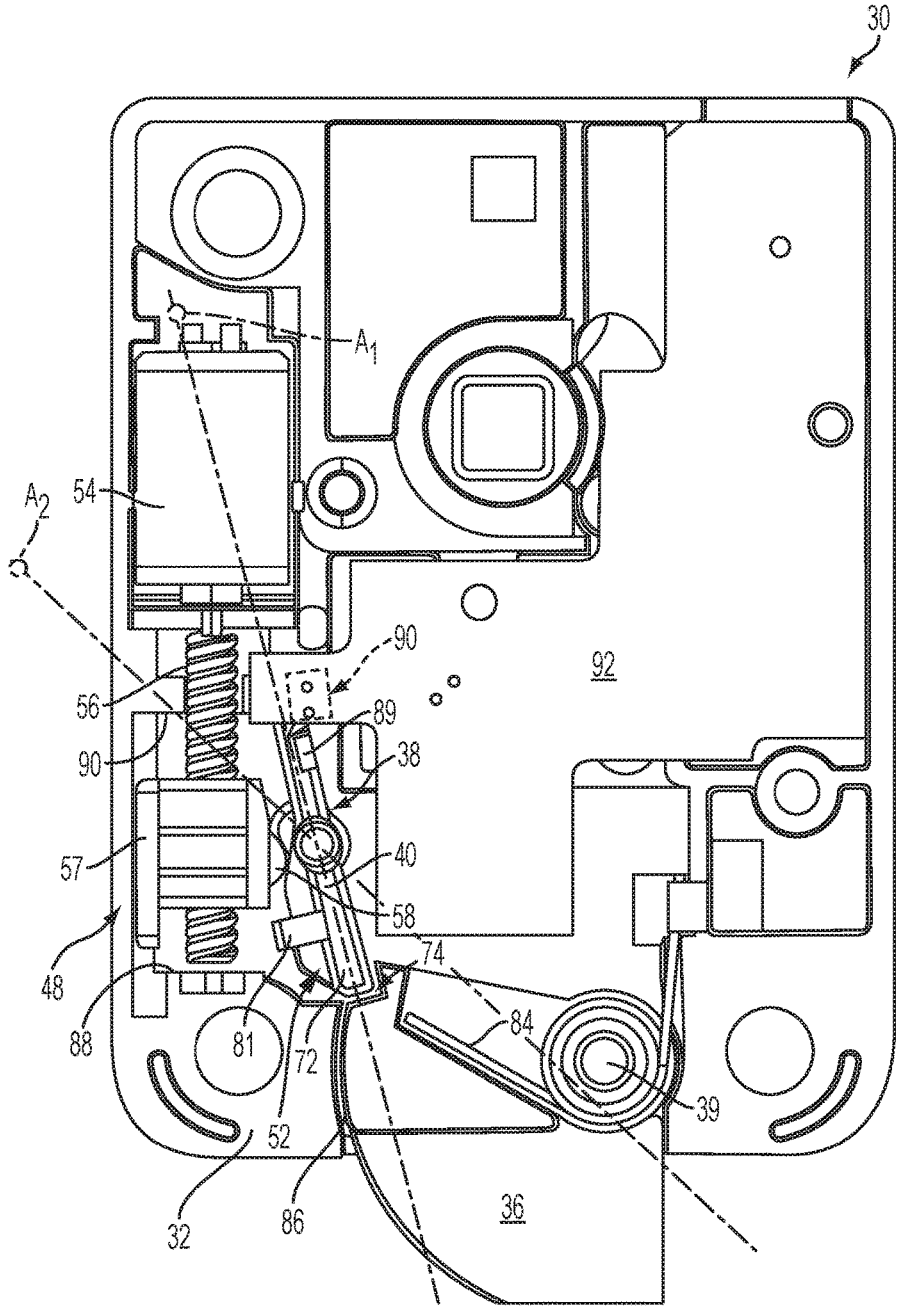
FIG. 7 is a view similar to FIG. 2 showing rotary bolt extending out of the case and the bolt blocker urged by the nut into a notch in the rotary bolt.

If rotary bolt 36 was moved inside housing 32 by bolt works 18, bolt blocker 38 would move to a position contacting rotary bolt 36 due to the counter-clockwise force applied by ball 58. When bolt works 18 are moved to the locked position, throw member 24 provides clearance for rotary bolt 36. torsion spring 84 rotates rotary bolt 36 outward to the position shown in FIGS. 7 and 12D. As rotary bolt 36 rotates, bolt blocker 38 rides on an edge 86 of rotary bolt 36 until tip 72 is again positioned in notch 74 as shown in FIG. 7.

Figure 12E:
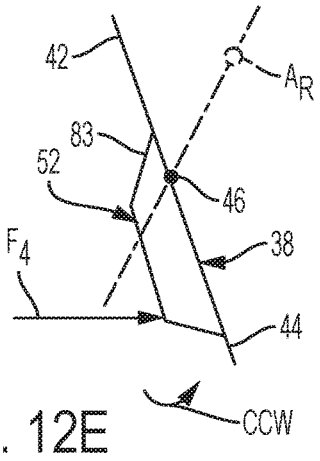

During this movement, movement of bolt blocker 38 is detected by a sensor. For example, a lug 89 of bolt blocker 38 strikes a switch 90 mounted on a PCB 92 as shown in FIG. 7. When switch 90 is moved by lug 89, the controller (not shown) recognizes that bolt blocker 38 is again positioned in notch 74. In response, the controller powers motor 54 to continue moving nut 48 downward in direction 79 until it strikes a portion of housing 32 as discussed below. As nut 48 moves further downward, applying force $F_4$ as shown in FIG. 12E, ball 58 moves further into recess 60 until it touches conical portion 68 so that ball 58 substantially bottoms out in nut body 57. Because ball 58 is substantially bottomed out, bolt blocker 38 is unable to push ball 58 any farther into nut body 57, and is therefore unable to rotate clockwise a sufficient distance, if at all, for tip 72 to leave notch 74 of rotary bolt 36. (The nut 48 has now reached a second terminal position.) Thus, if something applies an impact or physical shock to lock 20, bolt blocker 38 will continue to block retraction of rotary bolt 36.

Movement of nut 48 alters the range of motion of bolt blocker 38. For example, as noted above, when in the position shown in FIG. 2, bolt blocker 38 has a limited range of motion against ball 58 that is insufficient to allow bolt blocker 38 to move from a blocking position blocking retraction of rotary bolt 36 to the unblocking position permitting retraction of rotary bolt 36. When nut 48 moves to the position shown in FIG. 6, bolt blocker 38 has a greater range of motion against ball 48 and can move from the unblocking position to the blocking position. Thus, by operating motor 54 to move nut 48, the range of motion of bolt blocker 38 is adjusted as is the range of motion of ball 58.

According to one embodiment of the present invention, electric motor 54 is battery operated. As discussed above, motor 54 rotates shaft 56 to move nut 48 along shaft 56. The controller on PCB 92 monitors the electric current pulled by motor 54 to determine the position of nut 48 along shaft 56. When nut 48 reaches its end of travel on shaft 56, motor 54 draws additional current because nut 48 encounters additional resistance (ex. when nut 48 strikes either of walls 88, 90 of housing 32). The controller monitors this increased current and determines that nut 48 has reached its end position. The controller then turns off the electrical power supplied to motor 54.

Threaded shaft 56 includes a lead (i.e. the distance that nut 48 advances for one revolution of shaft 56). To reduce the likelihood of nut 48 from sticking or jamming at the ends of travel the lead should be sufficiently large. The necessary lead depends primarily upon the diameter of shaft 56 and the coefficient of friction between nut 48 and shaft 56. The nominal diameter of this shaft 56 is 0.156" and the lead is at least 0.094".

Figure 4:
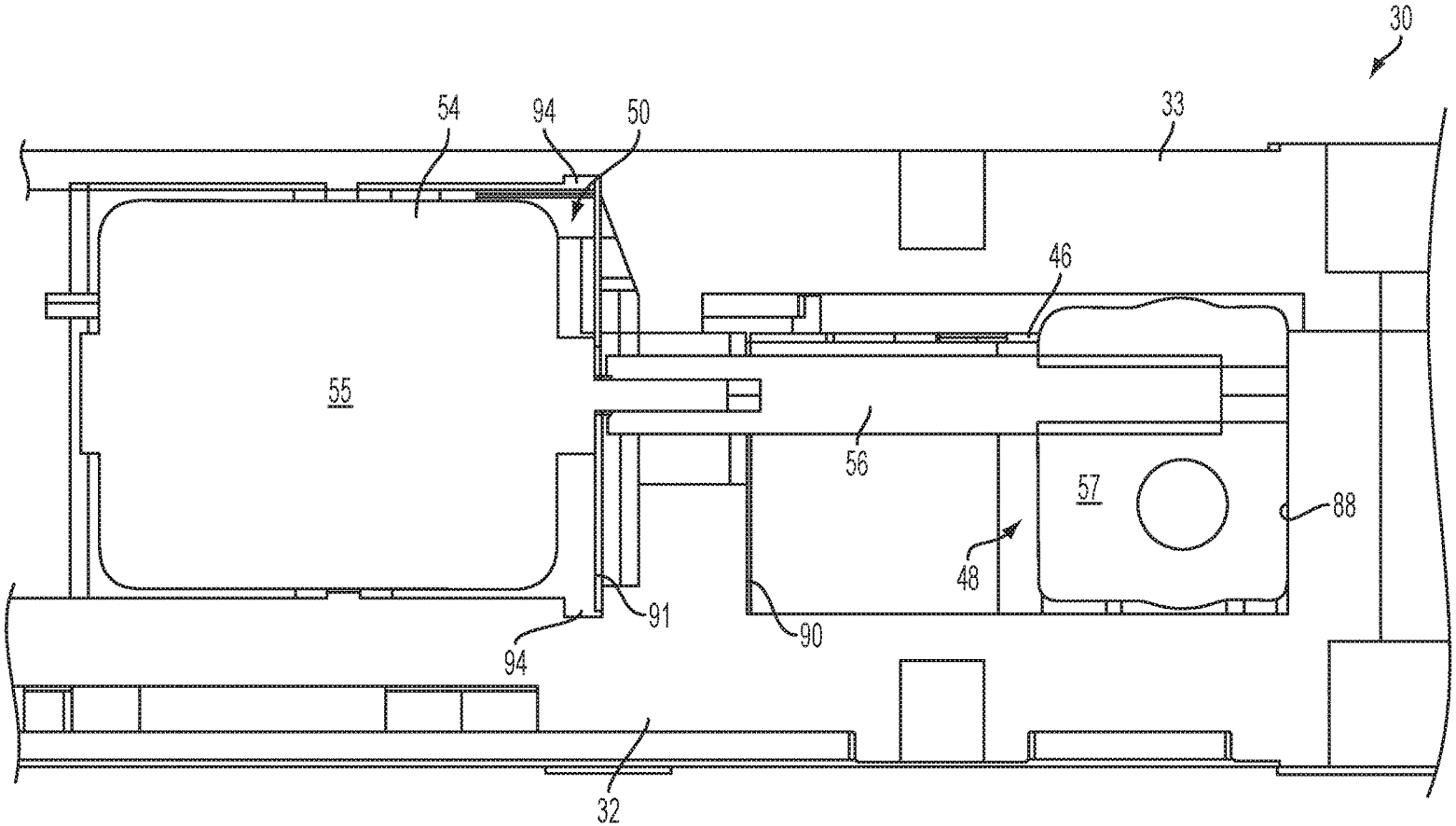
FIG. 4 is a cross-sectional view taken along line 4-4 of FIG. 2 showing the nut of FIG. 3 driven to a position by a threaded shaft extending into the nut and a motor driving the nut.

As shown in FIG. 4, a compliant member, such as leaf spring 91, supports motor 54 in an axial direction. Motor 54 floats within housing 32 to allow for unrestrained alignment of the components, such as nut 48 and shaft 56. Because of this floating, motor 54 may move relative to housing 32 during operation, creating linear inertia in motor 54.

Still referring to FIG. 4, leaf spring 91 is positioned in notches 94 in housing 32 and cover 33 and may be secured to motor 54. As nut 48 approaches wall 88, nut 48 (and often motor 54) has linear inertia and the rotor (not shown) of motor 52 and threaded shaft 56 have rotational inertia. Upon impact of nut 48 into wall 88, the kinetic energy of these inertias is absorbed by leaf spring 91 shown in FIG. 4. For example, when nut 48 runs into wall 88, leaf spring 91 bends slightly to the right to absorb the kinetic energy and motor 52 and threaded shaft 56 also move slightly to the right. Leaf spring 91 (or another such spring) may also be used to reduce the impact of nut 48 into wall 90. If motor 54 is attached to leaf spring 91, leaf spring 91 will bend to the left upon impact of nut 48 into wall 90. Springs other than leaf spring 91 may also be used to lessen the shock of nut 98 impacting walls 88 or 90. For example, a coil spring, elastic material, or other springs may be used.

Figure 8:
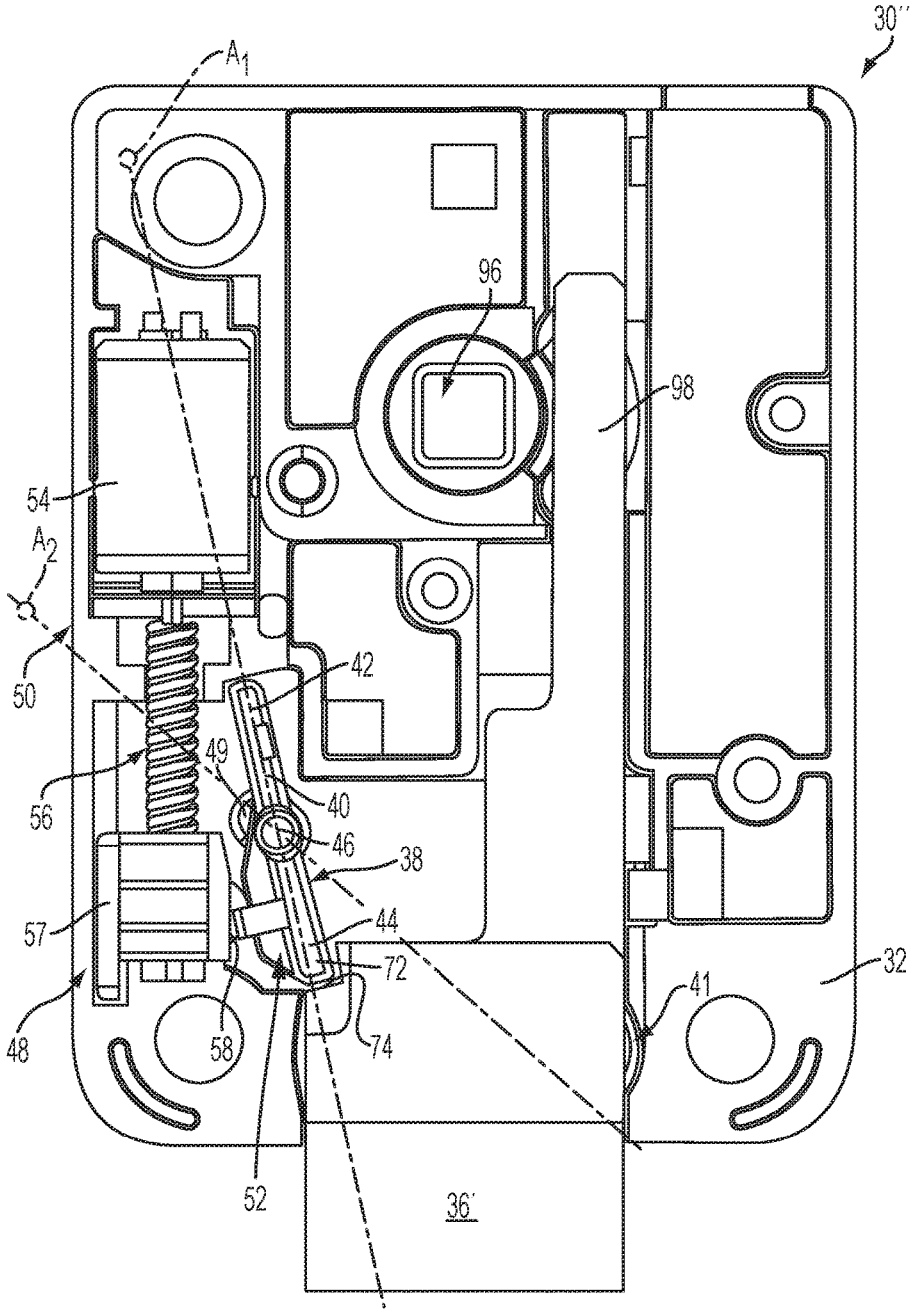
FIG. 8 is a view similar to FIG. 2 showing an alternative embodiment lock of the present invention with a linear bolt and the bolt blocker of FIG. 2 positioned to block retraction of the linear bolt.
Figure 9:
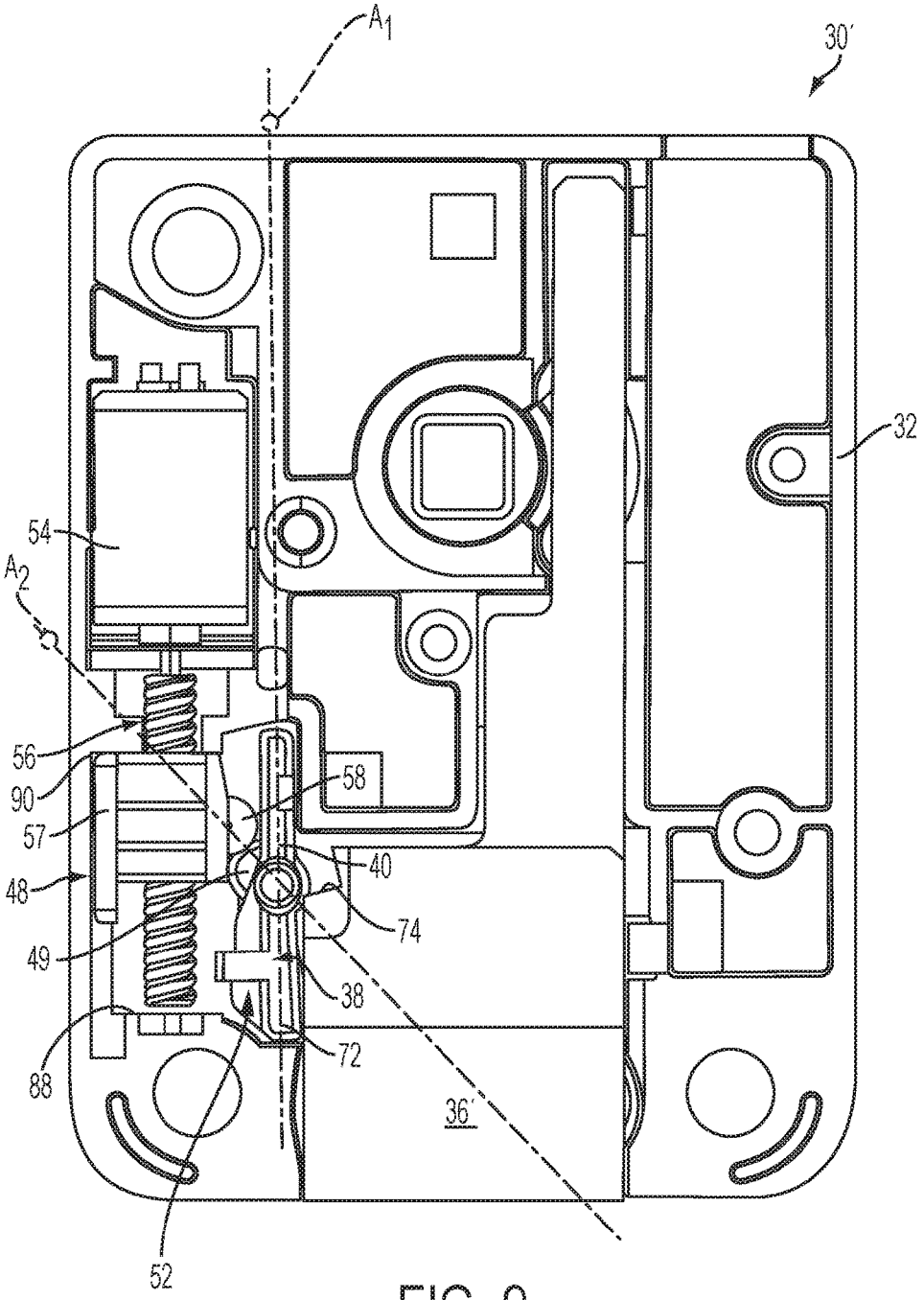
FIG. 9 is a view similar to FIG. 8 showing the nut driven to a raised position rotating the bolt blocker and allowing the linear bolt to retract into the case.
Figure 10:
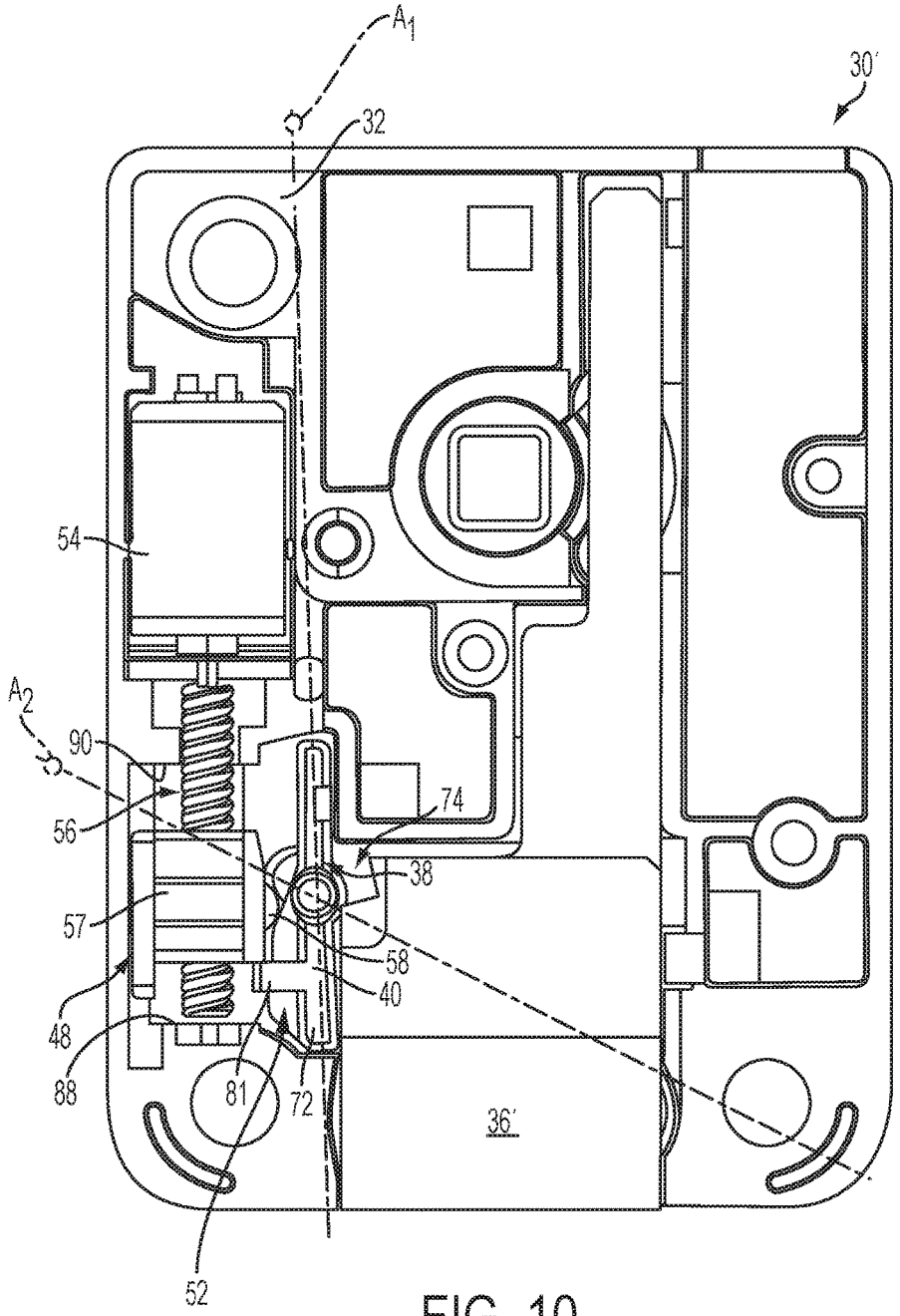
FIG. 10 is a view similar to FIG. 8 showing the nut driven back to an intermediate position urging the bolt blocker toward the linear bolt.
Figure 11:
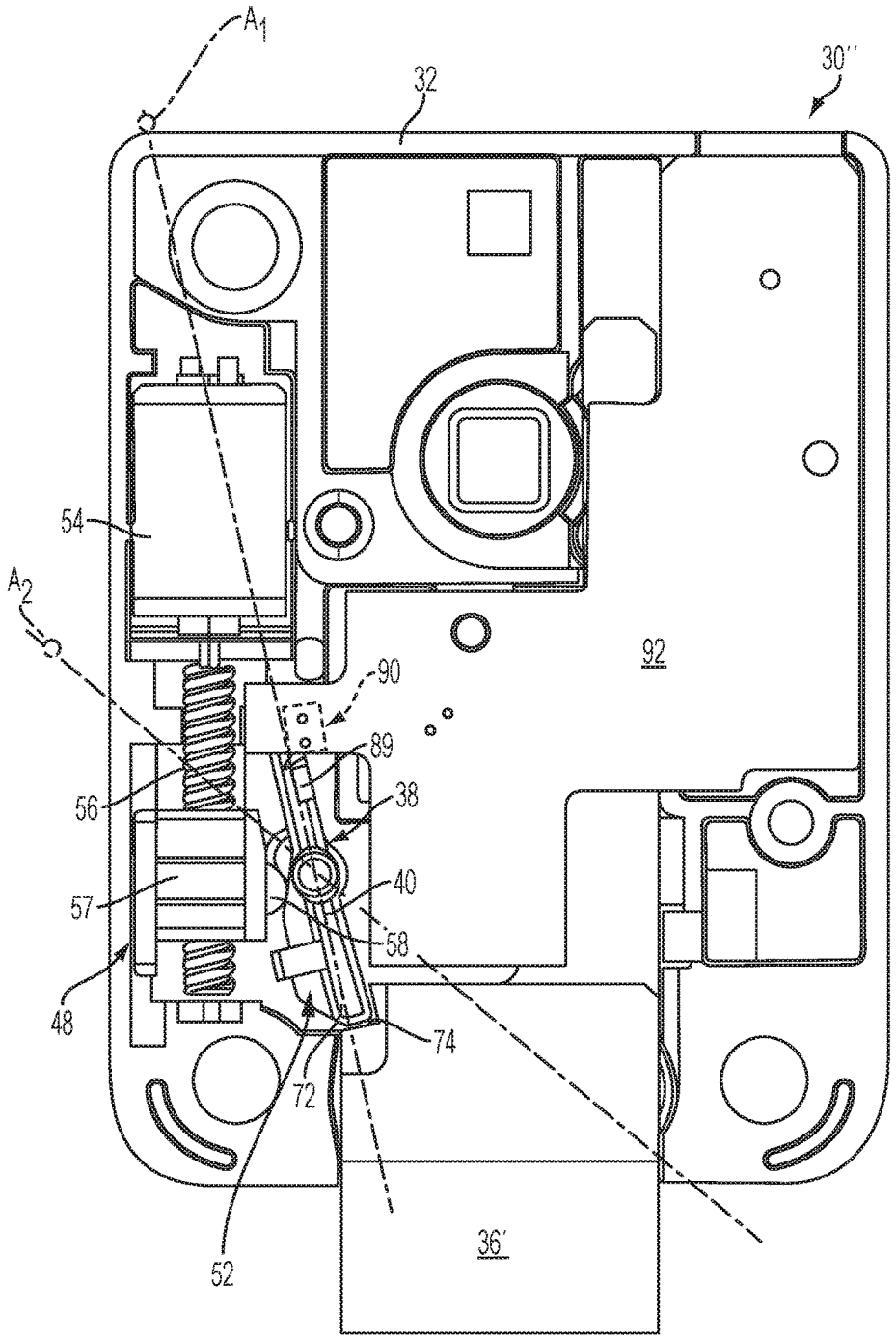
FIG. 11 is a view similar to FIG. 8 showing the linear bolt extending out of the case and the bolt blocker urged by the nut into a notch in the linear bolt.

Lock assembly 30' is shown in FIGS. 8-11. As mentioned above, lock assembly 30 includes a linear bolt 36'. Bolt blocker 38 blocks retraction of linear bolt 36' in a manner similar to that for rotary bolt 36. If external force is applied to linear bolt 36' (or rotary bolt 36), bolt blocker 38 will translate along oval-shaped recesses or slots 49 so a compressive load is applied to bolt blocker 38. When bolt blocker 38 is rotated so that linear bolt 36' can be retracted, a user rotates access control point 28, which may be a circular key pad dial. A spindle (not shown) extends through housing 32 and into spindle-receiving aperture 96 (FIG. 8). The spindle couples to a leg 98 of linear bolt 36' through a cam or other mechanism. The user rotates access control point 28, causing the spindle to rotate to retract linear bolt 36'. When it is time to re-secure safe 10, the user rotates the access control point 28 in the opposite direction to extend linear bolt 36'.

As mentioned above, many of the components of rotary lock assembly 30 and direct drive/translating lock assembly 30' are identical. Some features provided for rotary lock assembly 30, such as shaft-apertures 41, are provided in translating lock assembly 30' that are unnecessary. Similarly, some features provided for translating lock assembly 30', such as spindle-receiving aperture 96, are provided in rotary lock assembly 30 that are unnecessary. As a result, several regions are adapted to receive components, but are devoid of these components, such as shaft-aperture 41 being devoid of shafts in translating lock assembly 30' and spindle-receiving aperture 96 being devoid of a spindle in rotary lock assembly 30. Thus the housing 32 of the present invention, for example, is configured to selectively accept either the rotating lock assembly 30 or the translating lock assembly 30', thereby providing increased flexibility with a minimum of different components.

Many of the features and sub-features described herein function partially or totally independently of each other. Thus, many features and sub-features are optional depending on the needs of the particular circumstances. Additionally, features and sub-features described herein with reference to a particular embodiment may also be provided on the other embodiments described herein.

What is claimed is:

1. A lock assembly for securing a container having an interior region, comprising:

a housing, a bolt moveable relative to the housing between an extended position inhibiting access to the interior region of the container and a retracted position to facilitate access to the interior region, a blocking lever rotating relative to the housing between a blocking position blocking movement of the bolt to the retracted position and an unblocking position permitting the bolt to move to the retracted position, the blocking lever having a first lever arm and a second lever arm, and a positioning assembly including a threaded shaft, a motor that rotates the threaded shaft, and a nut that moves relative to the housing along the threaded shaft as the motor rotates the threaded shaft, the nut being engaged with, and applying a force to, the blocking lever, such that rotation of the motor adjusts the amount and/or the location of the force applied to the blocking lever by the nut, wherein the nut includes a nut body and a circular member supported by the nut body, the circular member rolling on the blocking lever as the nut moves relative to the housing along the threaded shaft.

2. The lock assembly of claim 1, wherein the circular member is a sphere.

3. The lock assembly of claim 1, wherein the nut further includes a spring urging the circular member toward the blocking lever.

4. A lock assembly for securing a container having an interior region, comprising:

a housing, a bolt moveable relative to the housing between an extended position inhibiting access to the interior region of the container and a retracted position to facilitate access to the interior region, a blocking lever rotating relative to the housing between a blocking position blocking movement of the bolt to the retracted position and an unblocking position permitting the bolt to move to the retracted position, the blocking lever having a first lever arm and a second lever arm, and a positioning assembly including a threaded shaft, a motor that rotates the threaded shaft, and a nut that moves relative to the housing along the threaded shaft as the motor rotates the threaded shaft, the nut being engaged with, and applying a force to, the blocking lever, such that rotation of the motor adjusts the amount and/or location of the force applied to the blocking lever by the nut, wherein the positioning assembly further includes a sensor positioned to detect the position of the blocking lever, the motor is controlled by sensor input generated by the sensor, and the motor moves the nut in response to the sensor detecting the blocking lever moving to the blocking position from the unblocking position, wherein the motor moves the nut from an intermediate position to a terminal position in response to the sensor, the nut contacting the blocking lever and permitting movement of the blocking lever when in the intermediate position, and the nut contacting the blocking lever and blocking movement of the blocking lever when in the terminal position, and wherein the nut includes a nut body and a circular member, the nut body having a interior region having a first portion permitting movement of the circular member and a second portion blocking movement of the circular member, the circular member contacting the second portion when the nut is moved to the terminal position.

* * * * *